US006497115B1

(12) United States Patent
Shirakata et al.

(10) Patent No.: US 6,497,115 B1
(45) Date of Patent: Dec. 24, 2002

(54) EVAPORATOR AND REFRIGERATOR

(75) Inventors: Yoshinori Shirakata; Yoichiro Iritani; Koji Hirokawa; Akihiro Kawada; Wataru Seki; Sunao Aoki, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/910,072

(22) Filed: Jul. 23, 2001

(51) Int. Cl.[7] ..... F25B 39/02; F25B 1/00; F25B 3/00; F28F 9/02

(52) U.S. Cl. ..... 62/515; 62/498; 62/524; 165/158; 165/910; 165/111

(58) Field of Search ..... 62/515, 524, 434, 62/484, 494; 165/157, 158, 910, 110, 111

(56) References Cited

U.S. PATENT DOCUMENTS 1,562,682 A * 11/1925 Braun ..... 165/110
2,254,189 A * 8/1941 Reed ..... 165/110
2,964,926 A * 12/1960 Ware ..... 62/515
2,995,341 A * 8/1961 Danesi ..... 257/32
3,191,396 A * 6/1965 Ruddock ..... 62/498
3,191,674 A * 6/1965 Richardson ..... 165/158
3,242,689 A * 3/1966 Chubb et al. ..... 62/498
3,250,084 A * 5/1966 Anderson ..... 62/212
3,257,817 A * 6/1966 Leonard ..... 62/98
3,267,693 A 8/1966 Richardson et al.
3,587,732 A * 6/1971 Burne ..... 165/158
4,671,082 A 6/1987 Maeda et al.
4,843,837 A 7/1989 Ogawa et al.

FOREIGN PATENT DOCUMENTS

EP 0 844 453 5/1998

* cited by examiner

*Primary Examiner*—William C. Doerrler
(74) *Attorney, Agent, or Firm*—Oblon, Spivak, McClelland, Maier & Neustadt, P.C.

(57) ABSTRACT

In an evaporator composed by providing plural heat-transfer pipes for flowing cold water in a container into which a refrigerant is introduced, the heat-transfer pipes are divided into plural pipe groups and the pipe groups are arranged in a zigzag pattern with intervals between each adjacent pipe groups. Bubbles which are generated around the heat-transfer pipes provided lower position, easily come to the surface of the refrigerant, and further, there are few bubbles which degrade the performance of the heat-transfer pipes positioned around the center of the pipe groups, preventing a fall in the heat transfer coefficient.

9 Claims, 6 Drawing Sheets

EVAPORATOR AND REFRIGERATOR

BACKGROUND OF THE INVENTION

1. Field of the Invention

The present invention relates to an evaporator for refrigerating a fluid to be refrigerated (for example, water, brine, and the like) by carrying out heat exchange of the fluid to be refrigerated and to a refrigerant, and relates to a refrigerator provided with the evaporator.

2. Description of Related Art

In a large structure such as a building, for example, water refrigerated by a refrigerator is circulated through piping arranged in the structure and heat exchange with air is carried out in individual spaces in order to perform cooling.

An embodiment of an evaporator provided in a refrigerator is shown in FIG. 9. The refrigerator is composed by providing plural heat-transfer pipes 2 for flowing cold water to a cylindrical container 1 into which a refrigerant is introduced, which are provided zigzaged in a bundle. The heat-transfer pipes 2 are divided into two kind of pipe groups which are outward heat-transfer pipes connecting to an inlet 3 for cold water and backward heat-transfer pipes connecting to an outlet 4 for cold water. Cold water flows in from the inlet 3 for cold water, flows through the outward heat-transfer pipes 2 into a water chamber (not shown in FIG. 9), returns to the water chamber, flows through the backward heat-transfer pipes 2, and flows out from the outlet 4 for cold water. In this step, cold water is refrigerated by heat-exchanging with the refrigerant introduced in the container 1 and as a result, the refrigerant boils and vaporizes.

Since plural heat-transfer pipes are used in a bundle in the conventional evaporator, the boiling refrigerant forms bubbles around the heat-transfer pipes provided at the lower part in the container and the bubbles are around the heat-transfer pipes provided over the lower heat-transfer pipes until the bubbles reach to the surface of the refrigerant. As a result, the rest of the refrigerant, which is not boiling, cannot be sufficiently supplied around the heat-transfer pipes provided at the upper part in the container. In particular, there is a problem in that the heat-transfer pipes provided around the center of the bundle have lower thermal conductivity than that of the heat-transfer pipes provided around them.

BRIEF SUMMARY OF THE INVENTION

In light of the above problem, an aim of the present invention is to provide an evaporator having high thermal conductivity, yielding an improvement in which remaining the bubbles formed by boiling the refrigerant in the container quickly surface without being around the heat-transfer pipes for a long time, and further, to provide a refrigerator having high cooling efficiency, provided with the evaporator.

To achieve the above aim, an evaporator and a refrigerator having the following structure are adopted. That is, the present invention provides an evaporator for refrigerating a fluid to be refrigerated and vaporizing a refrigerant by carrying out heat exchange between the fluid and the refrigerant, comprising plural heat-transfer pipes, in which the fluid flows, provided in a container into which the refrigerant is introduced, wherein the heat-transfer pipes are divided into plural pipe groups and the pipe groups are provided with an interval between adjacent pipe groups.

In this evaporator, since the heat-transfer pipes are divided into plural pipe groups and the pipe groups are provided with intervals between adjacent pipe groups, bubbles generated around the heat-transfer pipes positioned at lower positions of the pipe groups come to the surface through the intervals between adjacent pipe groups, and as a result, the bubbles around the heat-transfer pipes decrease to prevent fall of the heat transfer coefficient.

Furthermore, since the pipe groups are provided with intervals between adjacent pipe groups when the liquid refrigerant introduced in the container flows, the refrigerant flows easily. As a result, contact of the liquid refrigerant and the heat-transfer pipes is promoted to improve the heat transfer coefficient.

Furthermore, in the above evaporator, the plural pipe groups may be provided in a zigzag pattern in the container.

In the evaporator in which the liquid refrigerant is introduced into the lower part of the container and the refrigerant vaporized is flowed out from the upper part of the container, the liquid refrigerant tends to flow upward in the container. Then, the pipe groups are horizontally arranged in a zigzag pattern in the evaporator, and as a result, contact of the liquid refrigerant and the heat-transfer pipes is promoted to improve the heat transfer coefficient.

Furthermore, in the above evaporator, the pipe groups may comprise space in which the heat-transfer pipes are removed.

In the evaporator, since the space is provided in the pipe groups, bubbles rear the center of the pipe groups easily come to the surface. Therefore, bubbles which degrade the performance of the heat-transfer pipes positioned around the center of the pipe groups prevent a fall in the heat transfer coefficient.

Furthermore, in the evaporator, the heat-transfer pipes in all the pipe groups may be provided in a zigzag pattern.

As described above, the liquid refrigerant flows in the container after introduction. In the evaporator, since the heat-transfer pipes are arranged in a zigzag pattern, the refrigerant easily flows in the pipe groups and contact of the liquid refrigerant and the heat-transfer pipes is promoted to improve the heat transfer coefficient.

Furthermore, in the above evaporator, the pipe groups may be horizontally divided and the heat-transfer pipes provided in the pipe groups on the upper level are not more densely (more loosely) arranged than the heat-transfer pipes provided in the pipe groups on the lower level.

In the evaporator, since the heat-transfer pipes provided in the pipe groups on the upper level are not more densely arranged than the heat-transfer pipes provided in the pipe groups on the lower level, when bubbles generated around the heat-transfer pipes of the pipe groups positioned at the lower part of the container, pass through the pipe groups positioned at the upper part of the container, bubbles easily come to the surface through the intervals between adjacent heat-transfer pipes of the pipe groups.

The present invention provides to a refrigerator comprising: an evaporator for refrigerating a fluid to be refrigerated and vaporizing a refrigerant by carrying out heat exchange between the fluid and the refrigerant, comprising plural heat-transfer pipes in which the fluid flows provided in a container into which the refrigerant is introduced, a compressor for compressing the refrigerant vaporized in the evaporator, a condenser for condensing and liquefying the refrigerant compressed, and an expansion valve for decompressing the refrigerant liquefied at a step for flowing the refrigerant liquefied in the evaporator.

In the refrigerator, the heat transfer coefficient of the heat-transfer pipes in the evaporator is improved, and as a result, heat exchange coefficient is improved. Therefore, if energy consumption is set to a low level, performances at the same level as that of a conventional refrigerator, particularly, with respect to the refrigeration coefficient, is obtained.

DETAILED DESCRIPTION OF THE INVENTION

The first embodiment of an evaporator and a refrigerator according to the present invention will be explained with reference to FIGS. 1 to 3.

Figure 1:
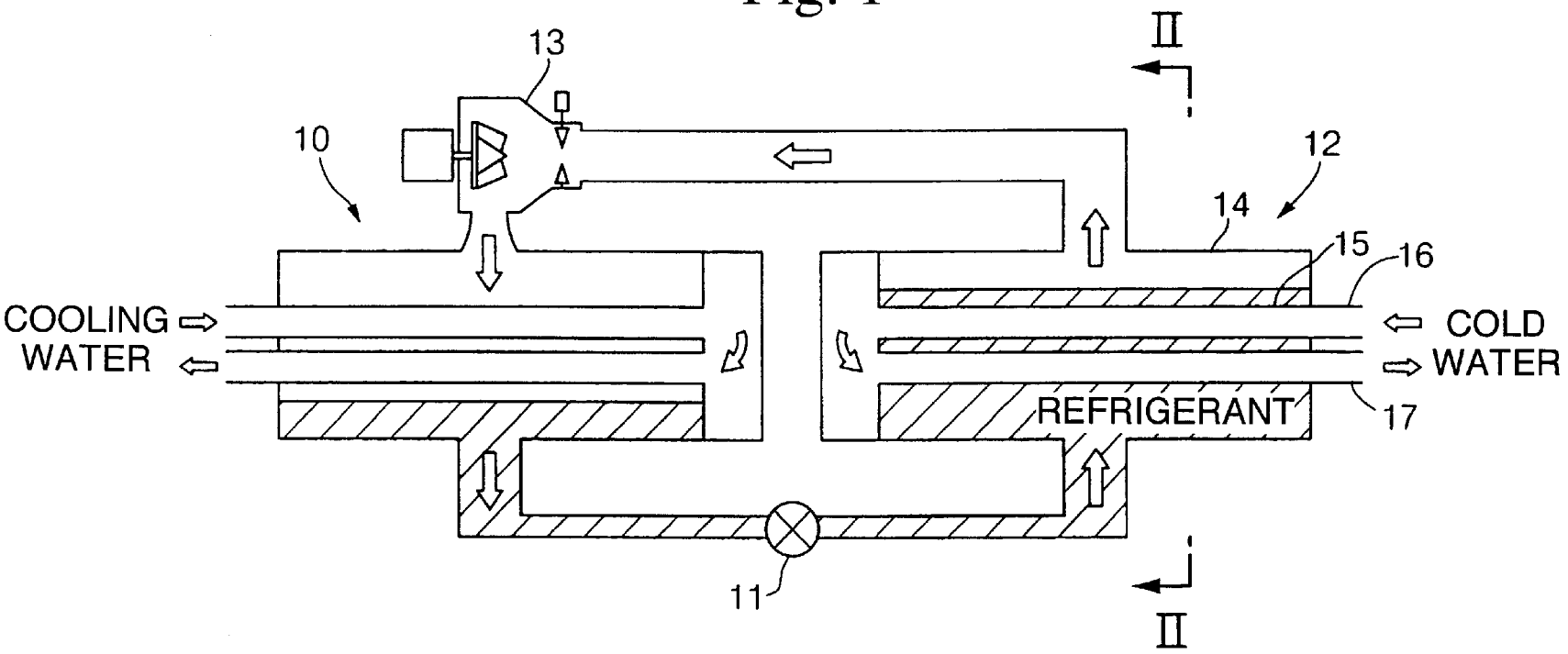
FIG. 1 is a schematic view of the first embodiment of an evaporator according to the present invention.

A schematic structure of the refrigerator of the present invention is shown in FIG. 1. The refrigerator in FIG. 1 comprises a condenser 10 which condenses and liquefies refrigerant by carrying out heat exchange between cooling water and a gaseous refrigerant, an expansion valve 11 for decompressing the refrigerant condensed, an evaporator 12 for refrigerating cold water by carrying out heat exchange between cold water (a material to be refrigerated) and the refrigerant condensed, and for vaporizing the refrigerant, and a compressor 13 for compressing the refrigerant vaporized and supplying the refrigerant compressed into the condenser 10. Cold water prepared in the evaporator 12 in the refrigerator is used for air conditioning in a building or the like.

In the evaporator 12, plural heat-transfer pipes 15 for flowing cold water in a cylindrical container 14 into which the refrigerant is introduced, are arrange in bundles (schematically shown in FIG. 1) and the bundles are provided in the longitudinal direction of the container 14. The heat-transfer pipes 15 are divided into two groups of outward pipes connecting to an inlet 16 for cold water and backward pipes connecting to an outlet 17 for cold water. Pipe lines (ducts) connecting to the inlet 16 for cold water and pipe lines connecting to the outlet 17 for cold water differ from each other in the direction of flowing cold water.

Figure 2:
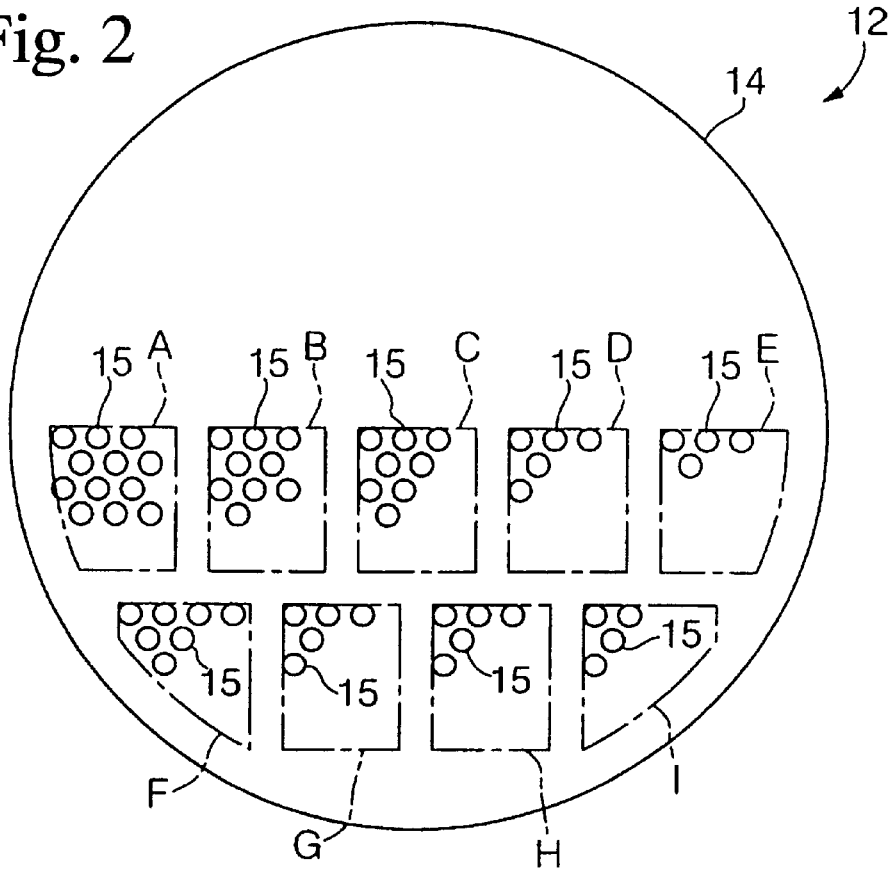
FIG. 2 is a cross-sectional view taken along line II—II of the evaporator shown in FIG. 1.

FIG. 2 shows a cross-sectional view of the evaporator 12. The heat-transfer pipes 15 are divided into nine groups A to I in the lower part of the container 14 and the groups A to I are provided in a zigzag pattern with intervals between adjacent groups. In particular, groups A to E are provided in parallel and groups F to I are provided in parallel below the groups A to E. Since the groups F to I are horizontally offset against the groups A to E, the groups A to I can be provided in a zigzag pattern.

Furthermore, in each group A to I, the heat-transfer pipes 15 are grouped together with approximately one hundred pipes and the heat-transfer pipes 15 are provided in a zigzag pattern in these groups A to I. Since the heat-transfer pipes 15 are provided so as to form multiple vertical steps and each step is horizontally offset against adjacent steps, the heat-transfer pipes 15 can be provided in a zigzag pattern.

Figure 3:
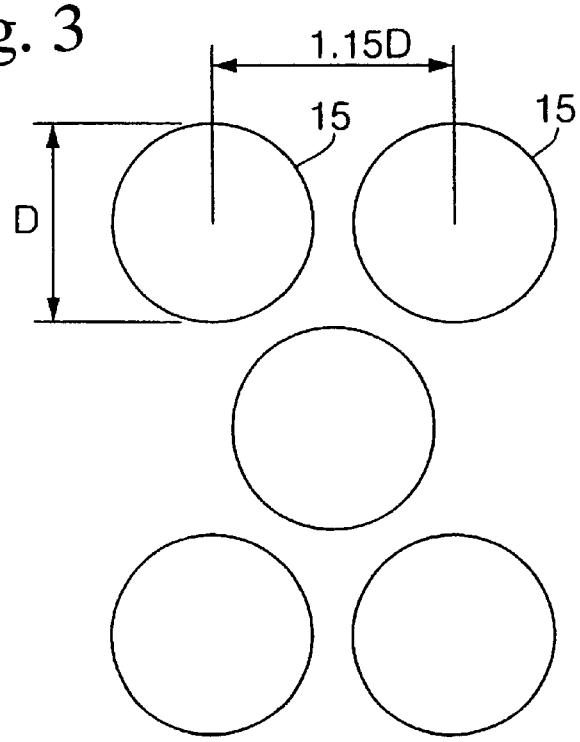
FIG. 3 is a view of an arrangement of heat-transfer pipes in the evaporator shown in FIG. 1.

Furthermore, in the heat-transfer pipes 15 provided in a zigzag pattern, when the diameter of a heat-transfer pipe 15 is set to D as shown in FIG. 3, the interval between the adjacent heat-transfer pipes is 1.15 D.

In the evaporator 12 composed as described above, since the heat-transfer pipes 15 are divided into pipe groups A to I and the pipe groups are provided with intervals between each adjacent pipe groups, bubbles generated around the heat-transfer pipes 15 at the lower part in each pipe group come to the surface of the refrigerant through the interval between the pipe groups. As a result, bubbles remaining around the pipe groups decrease. Therefore, bubbles which may have influence on the heat-transfer pipes 15 provided around the center of the pipe groups, decreases, and then the heat transfer coefficient can be prevented from decreasing.

Furthermore, liquid refrigerant is introduced from the lower part of the container 14 into the container 14 and vaporized to flow out through the upper part of the container 14. The refrigerant introduced tends to flow upward, and then, since the pipe groups are provided with intervals between each of the adjacent pipe groups, the refrigerant easily flows and contact of the refrigerant and cold water is promoted, and as a result, the heat transfer coefficient is improved.

Moreover, by arranging the pipe groups A to I in the container 14 in a zigzag pattern and arranging the heat-transfer pipes 15 in each pipe group A to I in a zigzag pattern, contact of the refrigerant flowing upward and the heat-transfer pipes 15 is promoted, and as a result, heat transfer coefficient is improved.

Since the evaporator 12 is composed of the structure as described above, the heat transfer coefficient is improved, and as a result, the refrigeration coefficient of the refrigerant is improved.

Furthermore, in the present embodiment, the heat-transfer pipes 15 are divided into nine pipe groups A to I; however, these pipe groups may be divided into smaller or larger numbers of pipe groups in line with the size of the evaporator 12 and desired properties to be exhibited. Moreover, the interval of each adjacent heat-transfer pipes horizontally provided is set to 1.15 D as described above, however, the interval is not limited and can be set in line with various requirements.

Next, the second embodiment of an evaporator and a refrigerator according to the present invention will be explained with reference to FIG. 4. Components already explained in the above first embodiment are assigned symbols as the same as those of FIGS. 1 to 3 and discussion thereof will be omitted.

Figure 4:
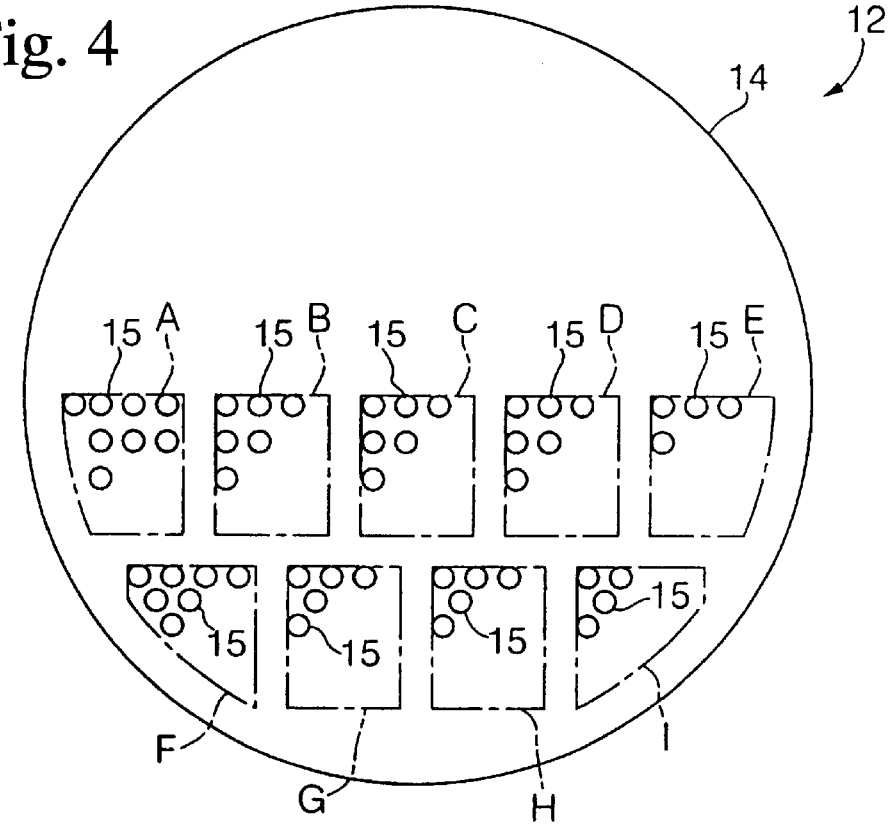
FIG. 4 is a cross-sectional view taken along line II—II of the second embodiment of the evaporator shown in FIG. 1.

FIG. 4 shows a cross-sectional view of the second embodiment of the evaporator 12. In the pipe groups A to E of the evaporator 12 according to this embodiment, the heat-transfer pipes 15 are regularly arranged vertically and horizontally; that is, the heat-transfer pipes 15 are arranged in a grid pattern. The heat-transfer pipes 15 in the pipe groups F to I are arranged in a zigzag pattern.

Furthermore, in the pipe groups A to E, the interval between each horizontally adjacent heat-transfer pipes 15 provided is set to 1.15 D, and the interval between each vertically adjacent heat-transfer pipes 15 is set to 2 to 3 D. On the other hand, in the pipe groups F to I, the interval between each of the horizontally adjacent heat-transfer pipes 15 is set to 1.15 D and the interval between each vertically adjacent heat-transfer pipes 15 is set to be narrower than that in the pipe groups A to E. That is, the heat-transfer pipes 15 in the pipe groups A to E are not more densely arranged than the heat-transfer pipes 15 in the pipe groups F to I.

In the evaporator 12 composed as described above, when bubbles generated around the heat-transfer pipes 15 in the pipe groups F to I pass through spaces between the heat-transfer pipes 15 in the pipe groups A to E, since the heat-transfer pipes 15 in the pipe groups A to E are not more densely arranged than those in the pipe groups F to I, bubbles easily pass through spaces between the heat-transfer pipes 15 in the pipe groups A to E. As a result, decrease of the heat transfer coefficient is prevented.

As described above, by using the evaporator 12 according to the second embodiment, the heat transfer coefficient can be improved, and as a result, the refrigeration coefficient of the refrigerator can be improved.

In the above second embodiment, the heat-transfer pipes 15 in the pipe groups A to E are arranged in a grid pattern and are not more densely arranged than those in the pipe groups F to I; however, a part of or all of the heat-transfer pipes 15 in the pipe groups A to E may be not more densely arranged in a zigzag pattern.

Figure 5:
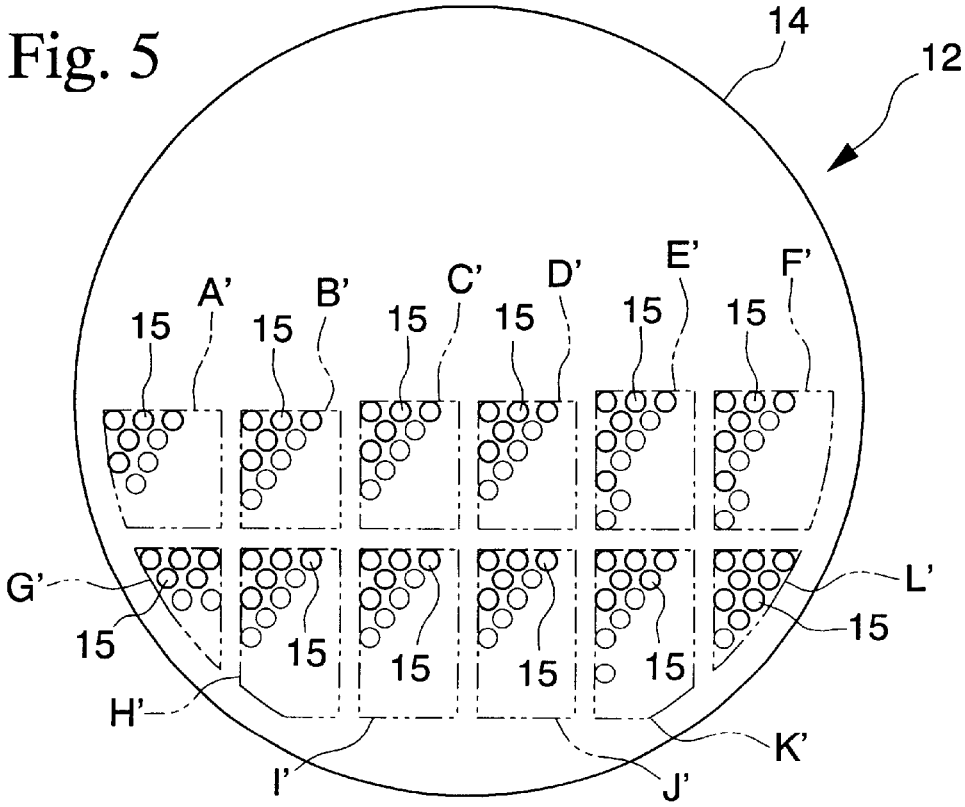
FIG. 5 is a cross-sectional view taken along line II—II of the third embodiment of the evaporator shown in FIG. 1.

FIG. 5 shows a cross-sectional view of another example of the second embodiment of the evaporator 12. The heat-transfer pipes 15 in pipe groups A' to L' are arranged in a zigzag pattern as well as the first embodiment.

In the pipe groups A' to F', the intervals between each adjacent heat-transfer pipes 15 are set to 1.15 D. Furthermore, in the pipe groups G' to L', the intervals between each adjacent heat-transfer pipes 15 are set to narrower than that in the pipe groups A' to F'. That is, the heat-transfer pipes 15 in the pipe groups A' to F' are not more densely arranged than the heat-transfer pipes 15 in the pipe groups G' to L'.

In the evaporator 12 arranged with the heat-transfer pipes 15 as described above, the pipe groups A' to F' and the pipe groups G' to L' are arranged in a grid pattern.

According to the above composition, when bubbles generated around the heat-transfer pipes 15 in the pipe groups G' to L' pass through spaces between the heat transfer pipes 15 in the pipe groups A' to F', since the heat-transfer pipes 15 in the pipe groups A' to F' are not more densely arranged than those in the pipe groups G' to L', bubbles easily pass through spaces between the heat-transfer pipes 15 in the pipe groups A' to F'. As a result, decrease of the heat transfer coefficient is prevented, and therefore, the heat transfer coefficient is improved, and as a result, the refrigeration coefficient of the refrigerator can be improved.

In the above composition, the heat-transfer pipes 15 in the pipe groups A' to F' are arranged in a grid pattern and are not more densely arranged than those in the pipe groups G' to L'; however, a part of or all of the heat-transfer pipes 15 in the pipe groups A' to F' may be loosely arranged in a zigzag pattern.

Next, the third embodiment of an evaporator and a refrigerator according to the present invention will be explained with reference to FIG. 6. The same symbols are appended to components already explained in the above first embodiment, and explanation with regard to these components will be omitted.

Figure 6:
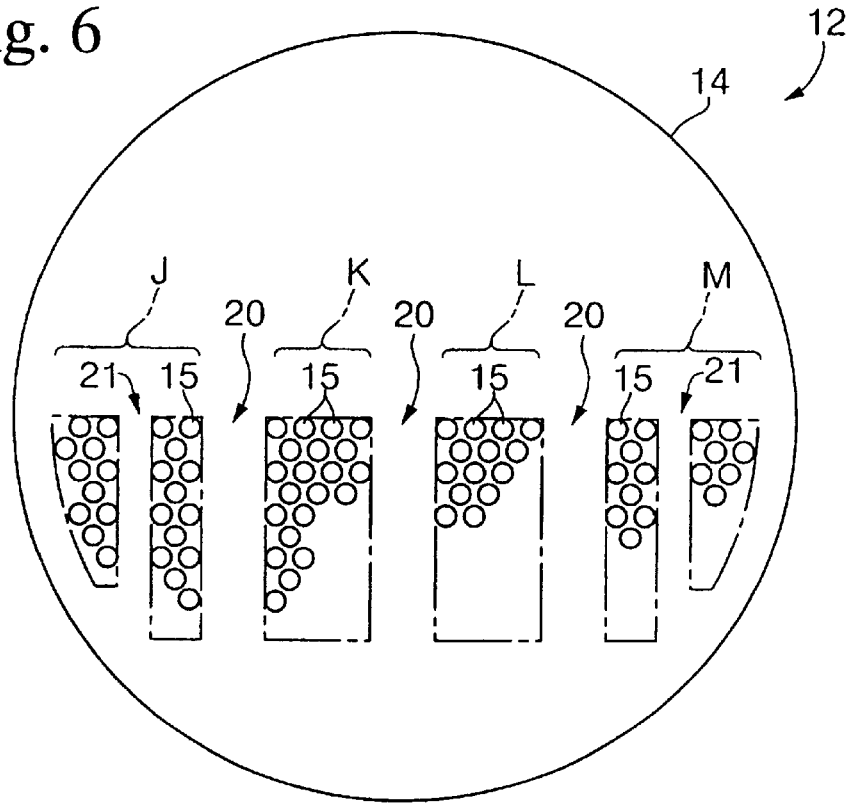
FIG. 6 is a cross-sectional view taken along line II—II of the fourth embodiment of the evaporator shown in FIG. 1.

FIG. 6 shows a cross-sectional view of the evaporator 12 according to the third embodiment according to the present invention. As shown in FIG. 6, in the evaporator 12 according to this embodiment, the heat-transfer pipes 15 are divided into four pipe groups J to M horizontally provided, and spaces between each of the adjacent pipe groups are provided so as to pass through vertically. The spaces are formed such that a predetermined number of the heat-transfer pipes 15, for example, two or three rows, are removed. These spaces are called degassing rows 20.

Furthermore, in the pipe groups J and M, spaces not arranged with the heat-transfer pipes 15 are provided in parallel with the degassing rows 20. These spaces are formed as if a predetermined number of the heat-transfer pipes 15, for example, one or two rows, are removed. These spaces are called auxiliary degassing rows 21.

In the evaporator 12 described above, since the degassing rows 20 and the auxiliary degassing rows 21 are provided, bubbles generated around the heat-transfer pipes 15 at the lower part of the pipe groups J to M come to the surface of the refrigerant through the degassing rows 20 and the auxiliary degassing rows 21. As a result, bubbles which deteriorate performance of the heat-transfer pipes 15 provided at the center and above the center, are decreased, and therefore, a fall in the heat transfer coefficient is prevented.

Next, the fourth embodiment of an evaporator and a refrigerator according to the present invention will be explained with reference to FIG. 7. The same symbols are appended to components already explained in the above first embodiment and explanation with regard to these components will be omitted.

Figure 7:
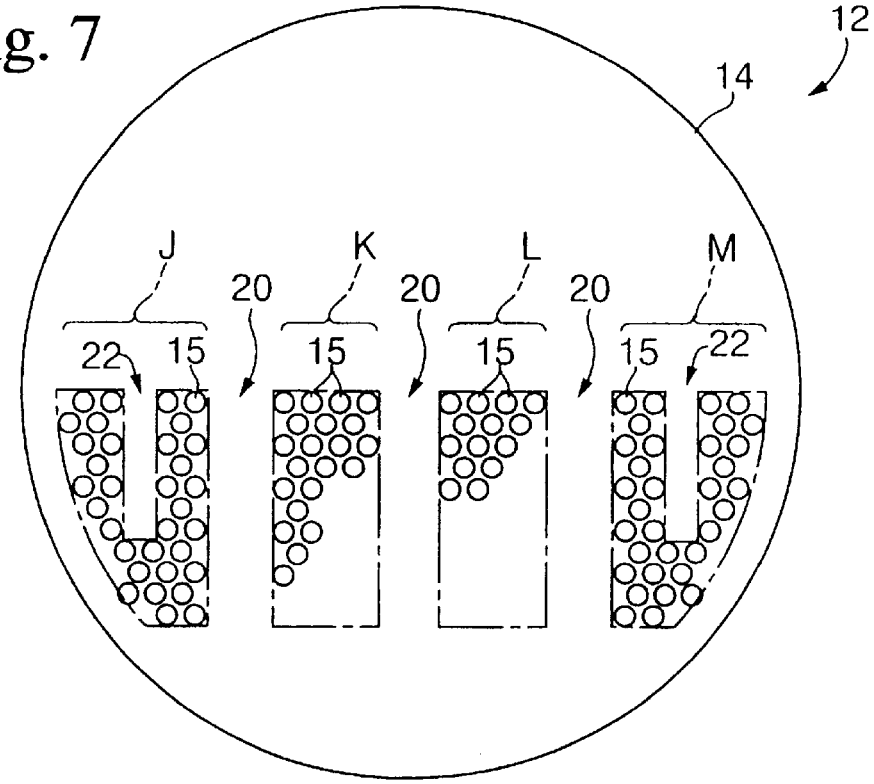
FIG. 7 is a cross-sectional view taken along line II—II of the fifth embodiment of the evaporator shown in FIG. 1.

FIG. 7 shows a cross-sectional view of the evaporator 12 according to the fourth embodiment according to the present invention. As shown in FIG. 7, in the evaporator 12 according to this embodiment, subauxiliary degassing rows 22 which are formed in the pipe groups J and M as if a predetermined number of the heat-transfer pipes 15 are removed. The subauxiliary degassing rows 22 do not pass through the pipe groups J and M and are not the same as the auxiliary degassing rows 21.

In the evaporator 12 composed as described above, since the subauxiliary degassing rows 22 are provided, bubbles rear the center of the pipe groups J and M easily come to the surface of the refrigerant. As a result, there are few bubbles, which degrade the performance of the heat-transfer pipes 15, around the center of the pipe groups J and M, and therefore, a fall in the heat transfer coefficient is prevented. Additionally, the subauxiliary degassing rows 22 may be provided at any of the pipe groups J to M.

Next, other embodiments will be explained as follows.

Figure 8:
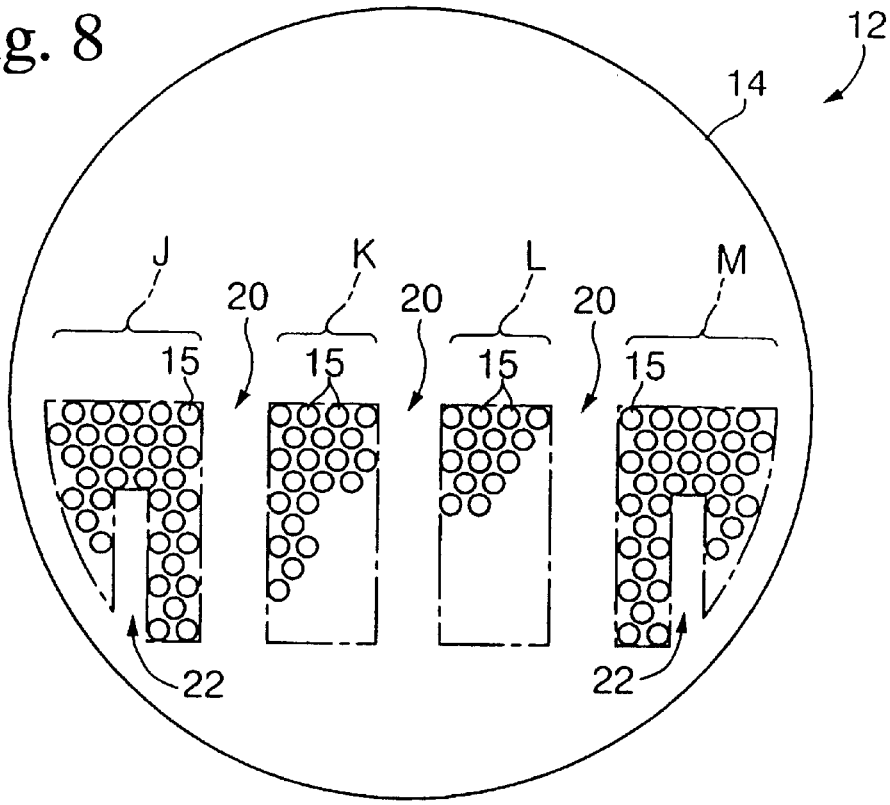
FIG. 8 is a cross-sectional view of another embodiment of the evaporator shown in FIG. 1.
Figure 9:
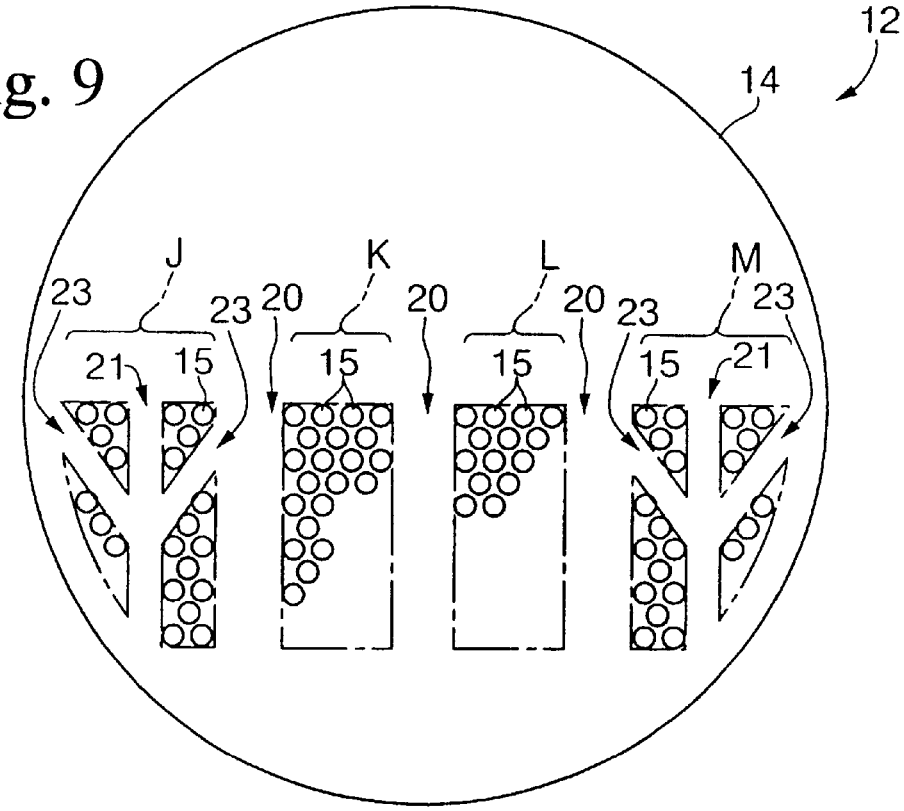
FIG. 9 is a cross-sectional view of another embodiment of the evaporator shown in FIG. 1.
Figure 10:
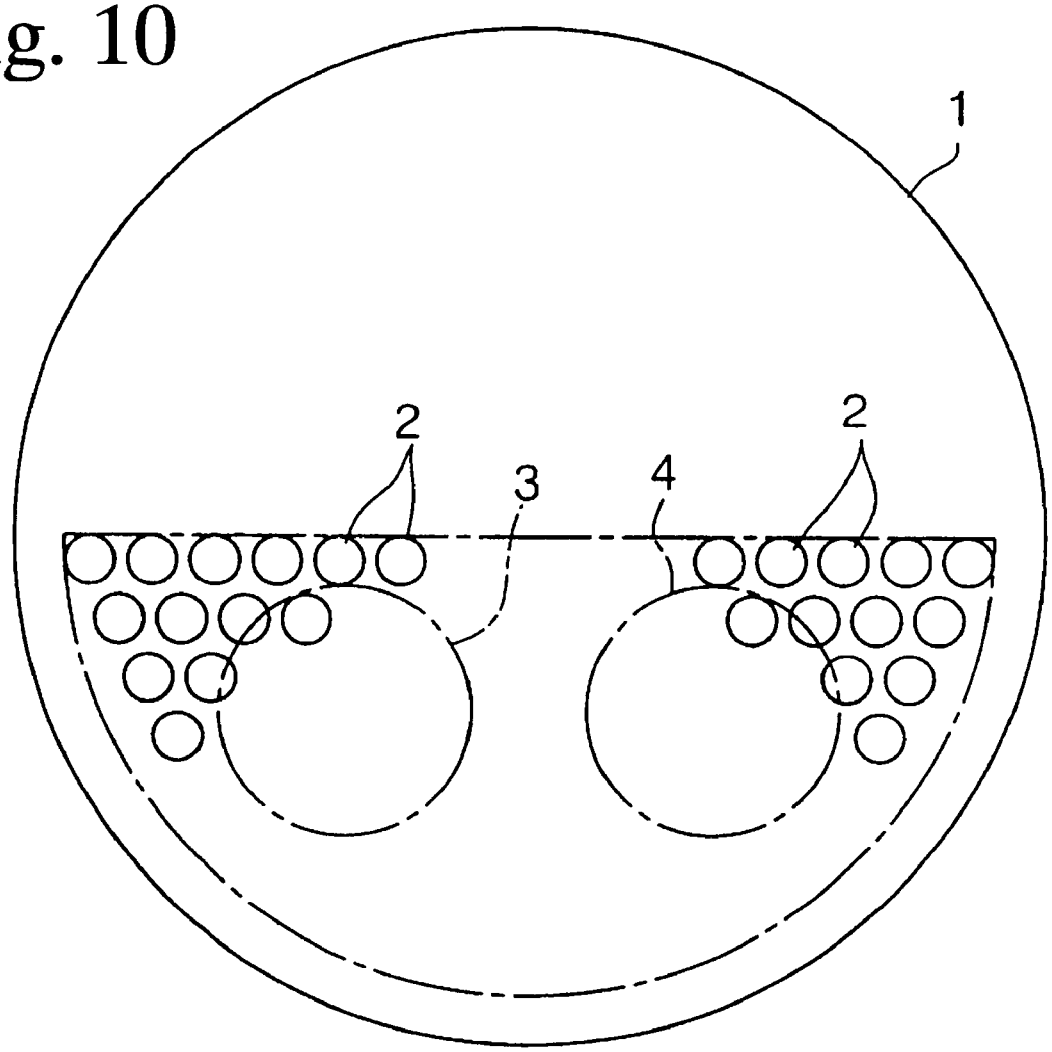
FIG. 10 is a cross-sectional view of a conventional evaporator provided in a refrigerator.

FIG. 8 is an example of the evaporator 12 in which subauxiliary degassing rows 22 are provided at the lower part of the pipe groups J and M. FIG. 9 is another example of the evaporator 12 in which smaller auxiliary degassing rows 23 than the auxiliary degassing rows 21 are provided so as to obliquely upward extend from the auxiliary degassing rows 21 to the degassing rows 20 through the pipe groups J to M.

The arranging pattern as described above is suitably selected in response to size or desired performance of the evaporator.

Furthermore, in the above-mentioned embodiments, as materials used for the heat-transfer pipes 15, tubes having various forms such as a dimple tube, fined tube, and the like can be used.

Moreover, in the above-mentioned embodiments, the evaporators having a structure in which cold water flows once and returns to the evaporator may be cited as examples; however, the evaporator according to the present invention may have structures in which cold water flows one way, flows and returns plural times, is input from one side; flows and returns; and output to the other side, and the like. That is, the above-mentioned arranging patterns can be applied to various evaporators.

What is claimed is:

1. An evaporator for refrigerating a fluid to be refrigerated and vaporizing a refrigerant by carrying out heat exchange between said fluid and said refrigerant, comprising plural heat-transfer pipes, in which said fluid flows, provided in a container into which the refrigerant is introduced, wherein said heat-transfer pipes are divided into plural pipe groups and said pipe groups are provided with intervals between adjacent pipe groups, wherein the pipe groups are provided in zigzag pattern in the container.

2. An evaporator according to claim 1, wherein space between pipes in a pipe group are the same size as an integral number of pipes.

3. An evaporator according to claim 1, wherein the heat-transfer pipes in all pipe groups are provided in a zigzag pattern.

4. An evaporator for refrigerating a fluid to be refrigerated and vaporizing a refrigerant by carrying out heat exchange between said fluid and said refrigerant, comprising plural heat transfer pipes, in which said fluid flows, provided in a container into which the refrigerant is introduced, wherein the heat-transfer pipes are divided into plural pipe groups and said pipe groups are provided with intervals between adjacent pipe groups.

5. A refrigerator comprising:

an evaporator for refrigerating a fluid to be refrigerated and vaporizing a refrigerant by carrying out heat exchange between said fluid and said refrigerant, comprising plural heat-transfer pipes, in which said fluid flows, provided in a container into which the refrigerant is introduced, a compressor for compressing the refrigerant vaporized in the evaporator, a condenser for condensing and liquefying the refrigerant compressed, and an expansion valve for decompressing the liquefied refrigerant flowing into the evaporator.

6. An evaporator according to claim 1, wherein the pipe groups are horizontally divided, and the heat-transfer pipes provided in the pipe groups on an upper level are more loosely arranged than the heat-transfer pipes provided in the pipe groups on a lower level.

7. An evaporator according to claim 4, wherein a space located between pipes in a pipe group are the same size as an intergral number of said pipes.

8. An evaporator according to claim 4, wherein the heat-transfer pipes in all pipe groups are provided in a zigzag pattern.

9. A refrigerator, which comprises:

an evaporator for refrigerating a fluid to be refrigerated and vaporizing a refrigerant by carrying out heat exchange between said fluid and said refrigerant, comprising a plurality of heat-transfer pipes, in which said fluid flows, provided in a container into which the refrigerant is introduced wherein said heat-transfer pipes are divided into a plurality of pipe groups, and said pipe groups are provided with intervals between the adjacent pipe groups and are provided in a zigzag pattern in the container;

a compressor for compressing the refrigerant vaporized in the evaporator, a condenser for condensing and liquefying the refrigerant compressed, and an extension valve for decompressing the liquefied refrigerant flowing into the evaporator.

* * * * *